US009415908B2

(12) United States Patent
Barron

(10) Patent No.: US 9,415,908 B2
(45) Date of Patent: Aug. 16, 2016

(54) RESEALABLE POURING SPOUT FOR A BAG CONSISTING OF FLEXIBLE FILM

(71) Applicant: Robert Bosch GmbH, Stuttgart (DE)

(72) Inventor: Dan Barron, Schaffhausen (CH)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 14/415,765

(22) PCT Filed: Jun. 3, 2013

(86) PCT No.: PCT/EP2013/061341

§ 371 (c)(1),
(2) Date: Jan. 20, 2015

(87) PCT Pub. No.: WO2014/012698

PCT Pub. Date: Jan. 23, 2014

(65) Prior Publication Data

US 2015/0175323 A1 Jun. 25, 2015

(30) Foreign Application Priority Data

Jul. 20, 2012 (DE) ..... 10 2012 212 769

(51) Int. Cl.

| | |
|---|---|
| ***B65D 47/06*** | (2006.01) |
| ***B65D 5/74*** | (2006.01) |
| ***B65D 75/58*** | (2006.01) |
| ***B65D 51/00*** | (2006.01) |

(52) U.S. Cl.

CPC ..... *B65D 47/06* (2013.01); *B65D 5/748* (2013.01); *B65D 51/002* (2013.01); *B65D 75/5877* (2013.01); *B65D 2547/063* (2013.01)

(58) Field of Classification Search

CPC ..... B65D 47/06; B65D 5/748; B65D 51/002; B65D 75/5877; B65D 2547/063

See application file for complete search history.

(56) References Cited

U.S. PATENT DOCUMENTS

| | | | | |
|---|---|---|---|---|
| 5,020,690 | A | 6/1991 | Kishikawa et al. | |
| 8,695,833 | B2 * | 4/2014 | Barron | B65D 51/221 215/344 |
| 8,720,744 | B2 * | 5/2014 | Barron | B65D 51/221 220/278 |
| 9,004,305 | B2 * | 4/2015 | Barron | B65D 5/747 220/258.4 |
| 2005/0236425 | A1 * | 10/2005 | Casale | B65D 5/748 222/83.5 |
| 2012/0241471 | A1 | 9/2012 | Barron | |
| 2013/0193146 | A1 * | 8/2013 | Barron | B65D 51/221 220/277 |
| 2015/0175323 | A1 * | 6/2015 | Barron | B65D 5/748 222/81 |

FOREIGN PATENT DOCUMENTS

| | | |
|---|---|---|
| EP | 1396435 | 3/2004 |
| EP | 1795456 | 6/2007 |
| JP | 11171233 | 6/1999 |
| JP | 2002104473 | 4/2002 |
| WO | 2011039054 | 4/2011 |

OTHER PUBLICATIONS

International Search Report for Application No. PCT/EP2013/061341 dated Aug. 29, 2013 (English Translation, 3 pages).

* cited by examiner

*Primary Examiner* — Frederick C Nicolas
*Assistant Examiner* — Bob Zadeh
(74) *Attorney, Agent, or Firm* — Michael Best & Friedrich LLP

(57) ABSTRACT

A resealable pouring spout for a bag, the spout having a pouring spout body (2) configured to be welded to the bag, a flange (3), a cutting device (1) having a flange-side cutting system (4), and a screwable sealing cap (5) on the pouring spout body (2). The pouring spout is configured to turn and displace the cutting device in a direction of the flange when the sealing cap is opened for the first time, and thereby cut open the bag.

8 Claims, 2 Drawing Sheets

RESEALABLE POURING SPOUT FOR A BAG CONSISTING OF FLEXIBLE FILM

BACKGROUND OF THE INVENTION

The invention relates to a resealable pouring spout for a bag consisting of flexible film.

This particular resealable pouring spout is in the form of one of the variants comprising a built-in cutting device, which variants are nowadays being used increasingly frequently. As is known, built-in cutting devices are so frequently used because a very large demand for easily producible containers which meet the hygiene conditions and are eco-friendly is fundamentally needed for the storage and transport of easily perishable goods such as foods, and because self-evidently, with wholly closed bags, the integrity of which is first in any way destroyed, by being cut open, only when used for the first time, the required standards with respect to freshness and sterility can be most likely guaranteed.

A resealable pouring spout of this type, for a bag consisting of flexible film, here consists of a pouring spout body, which can be welded to the bag and has a flange, a cutting device disposed in the pouring spout body and having a flange-side cutting system, and a screwable sealing cap placed onto the pouring spout body. The sealing cap is here provided with means in the form of drivers in order to move the cutting device in the direction of the flange when the sealing cap is opened for the first time, and thereby cut open the bag in the flange region and create a pour-out opening there. Although resealable pouring spouts of this type are known per se, they have the drawback that the currently known forms often fail to work wholly satisfactorily if they are welded directly onto the flexible film material of a tubular plastics bag. This has to do with the physical properties of the film material.

The problem stems namely from the fact that the hitherto used cutting devices are incompatible with some physical properties of the film material of which the bags consist, because, when the bags are pierced and cut open, effects in fact arise, which, in the opening of the container, are extremely undesirable.

If, namely, it is attempted to circularly cut open a flexible film in a known manner with a previously described cutting device and thus create a pour-out opening, it will be discovered that, although the flexible film can be pierced relatively easily, upon further turning of the sealing cap the cutting torque forces acting on already elastically deformed film increase with such rapidity that the flexible film can no longer withstand the torsional and shearing forces and tears uncontrollably. This leads to a situation in which not only is the further unscrewing of the screw cap, which for its part is obviously coupled with the cutting device, made much more difficult, but also, because of the uncontrollable tearing, no clearly defined pour-out opening whatsoever is formed, so that consequently the actual pouring out is also then heavily impaired. The case will namely frequently arise that film tabs which have been uncontrollably torn partially reclose the formed pour-out opening in the course of the pouring out. In somewhat simple terms, the problem could thus be paraphrased with the following analogy: it resembles the attempt to cut up a loosely held rubber band with a plastics knife.

This problem has, of course, been recognized. For reasons of resource-sparing material consumption, but also for reasons of transport security, it is nevertheless very sensible, of course, to use bags consisting of flexible film. If it is namely wished to achieve a situation in which flexible containers also survive dropping from different heights without damage, then care must be taken to ensure that the material used is flexible enough, since it would otherwise not in fact be able to absorb the impact energy and would burst.

One of the solutions for use in flexible containers is disclosed in EP-1 396 435. Although this publication describes a resealable pouring spout for a bag consisting of flexible material, it is here a case of a composite material comprising plastics and paper layers, so that in terms of its cutting-open characteristics, in particular, of course, owing to its higher basic stiffness, it has totally different properties than might be expected in a tubular bag consisting of pure plastics material. All the same, this cutting device does however have a structure comprising a plurality of cutting tooth groups, which are arranged distributed over a cutting circle circumference and protrude on a continually decreasing scale less far than a leading cutting tooth. With this arrangement, the cutting open is meant to be realized not solely by the leading cutting tooth, for it is wished to avoid, as far as possible, horizontal warping of the composite material.

A further solution is shown in WO2011/039504. This publication describes a resealable pouring spout for a bag consisting of plastics film material, i.e. for an actual tubular bag (pouch). The cutting device contained in this pouring spout has a structure comprising a plurality of cutting tooth groups, which are arranged distributed over a cutting circle circumference and the individual cutting teeth of which protrude continually less far in comparison to two respectively leading (forward or trailing) cutting teeth. Both the leading cutting teeth and the follow-up teeth, which latter are stepped at different heights, of the stepping tooth groups are all configured such that they taper to a point and are all designed for stock-removing cutting effect. In this cutting device, in the course of use, one after the other of the follow-up teeth is employed, according to the penetration depth. In this cutting device, too, it is naturally a question of as far as possible avoiding, or at least minimizing, the effect, which arises still more markedly in pure plastics film material, of horizontal warping, or even uncontrolled tearing, of the film material as it is cut open.

In bags consisting of flexible film, precisely owing to the low stiffness of the plastics film material, cutting systems, i.e. systems of actual cutting teeth, have the drawback that a clean cut—once the starting cut or the penetration is realized—can subsequently be maintained only with even greater difficulty. As already mentioned, this has to do with the fact that the material to be cut through would have to remain taut for as long as possible in order to obtain a clean cut.

SUMMARY OF THE INVENTION

The object of the invention is therefore to define an improved resealable pouring spout of the generic type, comprising a cutting device for a bag consisting of flexible plastics film, with which pouring spout the flexible plastics film can be cut open, as far as possible, without complication.

The solution is based on the fact that it is possible to minimize, or even wholly avoid, complications in the course of cutting open if the plastics film is suitably prepared and weakened before it is actually cut through. It has been shown that a cutting device having a basic structure as defined in the preamble to patent claim 1 is particularly suitable for this purpose. Accordingly, a cutting device comprising a cutting system is present,

- wherein the cutting system of the cutting device has at least one cutting tooth group extending over a part of a cutting circle circumference, and
- wherein the cutting tooth group respectively has a number of cutting teeth, and wherein the cutting teeth of the cutting tooth group are arranged such that a leading cutting tooth in a cutting direction protrudes farthest in an axial direction, and the further cutting teeth, following on from the leading cutting tooth, of the cutting tooth group protrude on a continually decreasing scale less far in the axial direction.

The desired preparation and weakening effect can be achieved by the leading cutting tooth in the at least one cutting tooth group having a flattening running parallel to the flange, and by the further cutting teeth, following on from the leading cutting tooth, of the cutting tooth group having constantly diminishing flattenings following an equal course.

This essentially has the effect that the film material, at the places at which it comes into contact with the cutting teeth, is initially stretched to its elastic limit, and that it thus, at the same time, is also naturally weakened and made thinner. If the elastic limit is reached, those cutting teeth of the cutting tooth group which follow on from the leading cutting tooth and which, by virtue of the inventive shaping, are designed increasingly for cutting effect, can then cut through the film material with greater ease and reliability.

Advantageously, in terms of the cutting tooth group, the leading cutting tooth in the cutting direction is also for its part, on an edge leading in the cutting direction, in turn provided with a chamfer on the flattening, in order to avoid premature penetration of the flexible film. Such a geometry allows the leading cutting tooth to be able to slide initially more smoothly along the surface of the film material without thereby already tearing through the film material. This has the effect however—naturally also in interaction with the following follow-up teeth, designed increasingly for scoring and cutting effect—that a further weakening of the plastics film material is also initially realized by means of striation. In somewhat simplified terms, it can thus be said that the (blunter) leading teeth produce a weakening, and that the following (more pointed) teeth then effect the cutting through or severance.

BRIEF DESCRIPTION OF THE DRAWINGS

Further advantageous embodiments of the subject of the invention emerge from the dependent claims, and their significance and working method are described in the following description with reference to the appended drawing.

A preferred illustrative embodiment of the subject of the invention is represented in the drawing, wherein.

DETAILED DESCRIPTION

Figure 1:
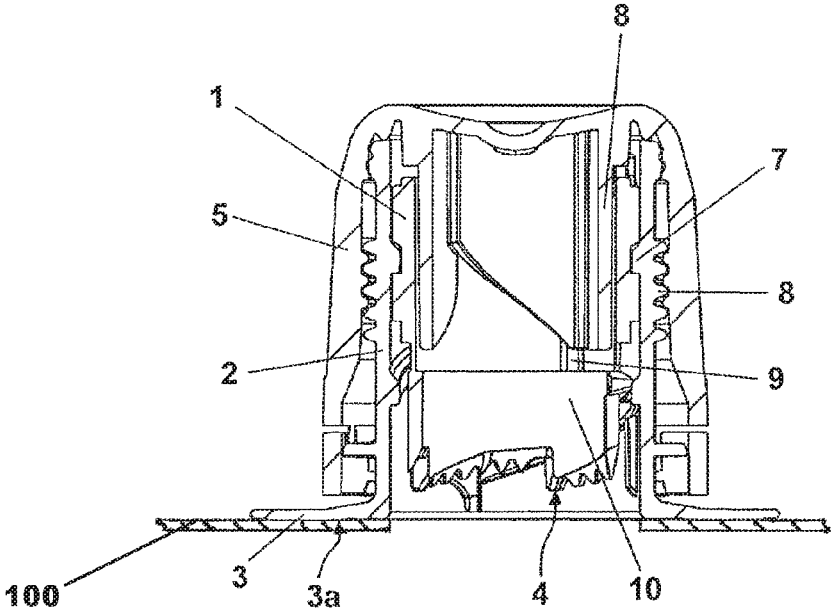
FIG. 1 shows a cross section through a pouring spout according to the invention with built-in cutting device.

FIG. 1 shows a cross section through a pouring spout according to the invention with built-in cutting device. The main component parts of the resealable pouring spout are a pouring spout body 2, which can be welded to a bag 100 and comprises a circumferential flange 3, a cutting device 1 disposed in the pouring spout body 2 and having a flange-side cutting system 4 integrally connected thereto, and a screwable sealing cap 5 placed onto the pouring spout body 2. The pouring spout is welded to the bag at connecting regions 3*a* of the flange 3.

Since pouring spouts of this type, with integrated cutting devices, are fundamentally known, their individual parts and functions are discussed below only in summary and, for the purpose of better guidance, in abbreviated form. Thus the pouring spout body 2 has on the outer side a fine-pitch thread 6, for receiving the sealing cap 5, and on the inner side a guide thread 7, in which the cutting device 1 is forcibly guided upon the unscrewing of the sealing cap 5 and turned and displaced in the direction of the flange 3. The transmission of the torque from the sealing cap 5 to the cutting device 1 is here realized via drivers 8 on the sealing cap 5 and via protruding ribs 9 on the inner wall of the cutting device 1. For the assembly of the pouring spout, the drivers 8 on the sealing cap 5 are oriented in relation to the protruding ribs 9 on the inner wall of the cutting device 1, after which the sealing cap 5 is pressed onto the pouring spout body 2, whereby also the cutting device 1 engages in the pouring spout body 2 in the correct (represented) positioning. Subsequently, the shown resealable pouring spout can then be opened by turning of the sealing cap 5 in the counterclockwise direction. When opening takes place for the first time (and only then), the cutting device 1 is employed. FIG. 1 thus shows the pouring spout according to the invention as it appears following manufacture or prior to initial opening.

Figure 2:
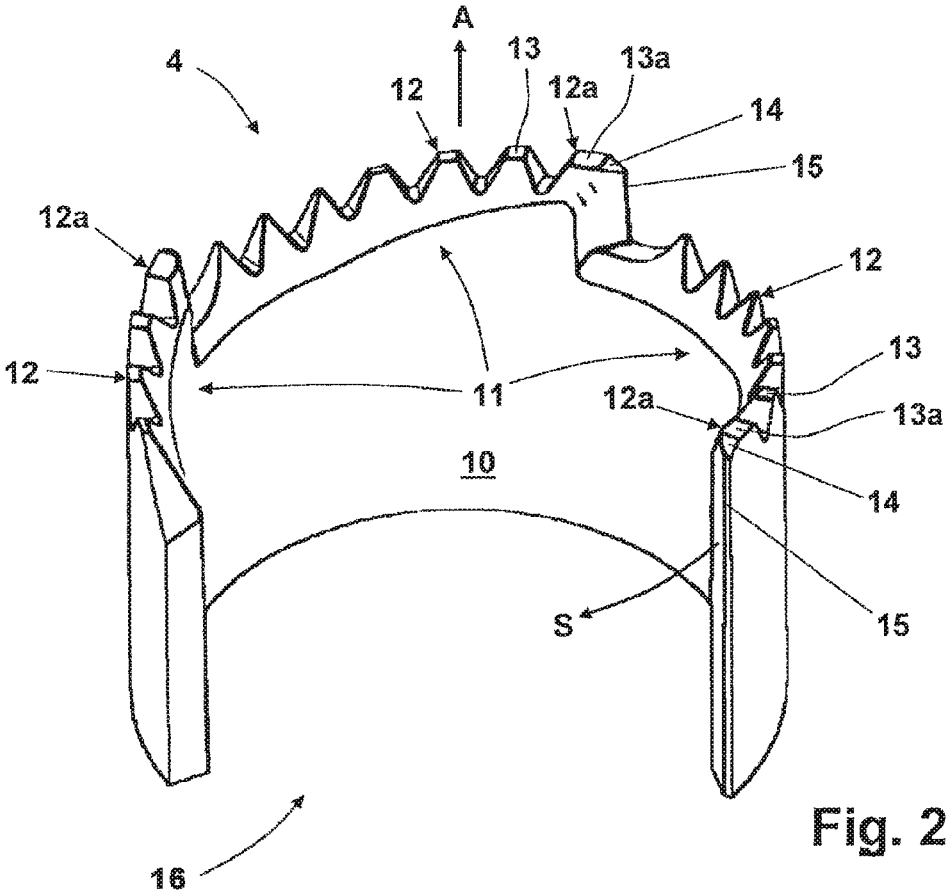
FIG. 2 shows a three-dimensional view of the cutting system of the cutting device according to FIG. 1.

FIG. 2 shows a three-dimensional view of the cutting system 4 of the cutting device 1 of FIG. 1. The cutting system 4 is integrally molded onto a body 10 consisting of a partially cylindrical wall. In this illustrative embodiment, the cutting system 4 here has three cutting tooth groups 11 extending over respectively a part of a cutting circle circumference. Each of these cutting tooth groups has a number of cutting teeth 12 and, moreover, the cutting teeth 12 in each cutting tooth group 11 are arranged such that a leading cutting tooth 12*a* in a cutting direction S protrudes farthest in an axial direction A (see, in this regard, also FIG. 1). It can additionally be seen that the further cutting teeth 12, following on from the leading cutting tooth 12*a*, of the cutting tooth group 11 protrude on a continually decreasing scale less far in the axial direction A. Finally, it can also be seen that the leading cutting tooth 12*a* in the (respective) cutting tooth group 11 has a flattening 13*a*, and that the further cutting teeth 12, following on from the leading cutting tooth 12*a*, of the cutting tooth group 11 have constantly diminishing flattenings 13. Thus the advance cutting teeth 12*a* which take the lead in the cutting operation and the leading cutting teeth 12*a* which first come into contact with the plastics film of the tubular bag are clearly blunter than the following, and increasingly more pointed cutting teeth 12.

The flattenings 13, 13*a* here lie substantially in a plane whose normal vector corresponds to the rotational axis of the cutting device 1 and is thus defined by the axial direction A. Synonymously, it can therefore also be said that the flattenings 13, 13*a* run parallel to the flange 3. It is additionally apparent that all flattenings follow an equal course. Naturally it is also possible that the flattenings can acquire slightly different orientations or configurations, yet substantially serve the same purpose.

It can further be seen that the respectively leading cutting tooth 12*a* in the cutting direction S has, for its part, frontally in the cutting direction an inclined chamfer 14 on the flattening 13*a*. Premature penetration of the flexible film shall thereby be avoided. Naturally, it is also possible that the flattening 13*a* and chamfer 14 merge steplessly into one another, yet substantially also again serve the same purpose.

FIG. 2 shows also that the chamfer 14 opens out in an extensively tapered manner into a cutting edge 15 running substantially parallel to the axial direction A of the cutting device 1. This cutting edge 15 is present in all existing cutting tooth groups 11 and extends in the outer face of the body 10.

FIG. 2 further shows that the cutting system 4 of the cutting device 1 has in a sector of the cutting circle circumference an outflow recess 16. The mutual alignment of the cutting tooth groups 11 thus does not extend over the whole of the cutting circle circumference, thereby ensuring that a bag consisting of flexible film is completely emptiable.

Finally, FIG. 2 also shows that the cutting system 4 of the present illustrative embodiment has three cutting tooth groups 11 in total, and that these three cutting tooth groups 11 are arranged distributed over at least three-quarters of the cutting circle circumference. With this distribution, the axially acting forces in the penetration operation shall at least approximately be balanced.

Figure 3:
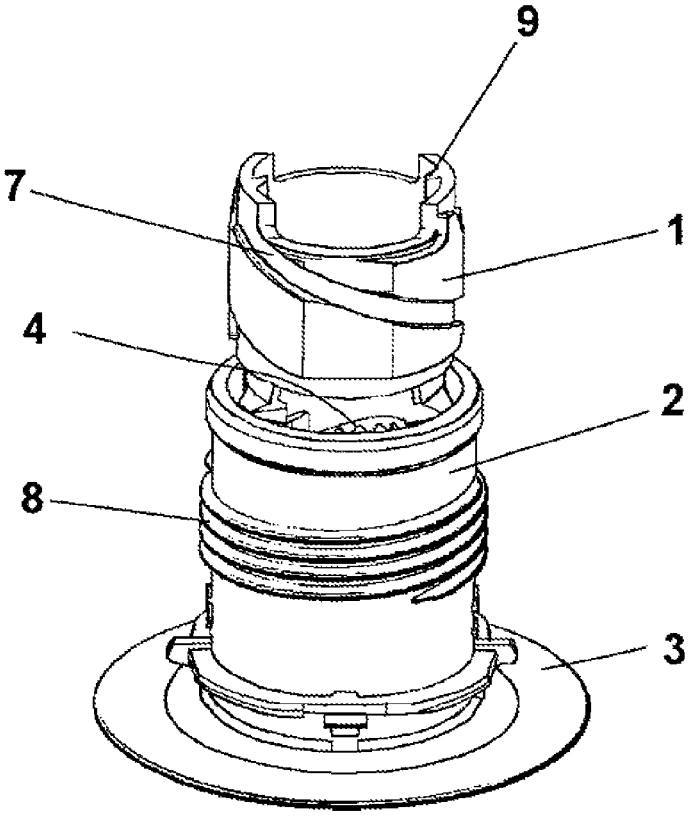
FIG. 3 shows a three-dimensional view of subcomponents of the pouring spout according to FIG. 1 during assembly.

Finally, FIG. 3 shows another three-dimensional view of subcomponents of the pouring spout according to FIG. 1 in a phase of the assembly. This representation serves merely for better understanding of the total concept. It illustrates the state immediately before the cutting device 1 is slid into the pouring spout body 2 for the purpose of assembling the pouring spout. To this end, the aforementioned drivers 8 of the sealing cap 5 are positioned against the ribs 9 of the cutting device 1, after which the sealing cap 5 is pressed over the pouring spout body 2 until it reaches the end position shown in FIG. 1. In this operation, the cutting device 1 is also, of course, slid into the pouring spout body. Following completed assembly, the pouring spout can then be welded with the flange 3 onto a bag consisting of flexible plastics film.

The invention claimed is:

1. A resealable pouring spout for a bag made of flexible film, wherein the resealable pouring spout comprises a pouring spout body (2), which is configured to be welded to the bag and has a flange (3), a cutting device (1) disposed in the pouring spout body and having a flange-side cutting system (4), and a screwable sealing cap (5) on the pouring spout body (2), and wherein the pouring spout is configured to turn and displace the cutting device in a direction of the flange when the sealing cap is opened for the first time, and thereby cut open the bag in a region of the flange, wherein the cutting system (4) of the cutting device (1) has at least one cutting tooth group (11) extending over a part of a cutting circle circumference, wherein the cutting tooth group (11) respectively has a number of cutting teeth (12, 12*a*), wherein the cutting teeth of the cutting tooth group (11) are arranged such that a leading cutting tooth (12*a*) in a cutting direction protrudes farthest in an axial direction (A), and further cutting teeth (12), following on from the leading cutting tooth (12*a*), of the cutting tooth group (11) protrude on a continually decreasing scale less far in the axial direction (A), and wherein the leading cutting tooth (12*a*) in the cutting tooth group (11) has a flattening (13*a*) running parallel to the flange (3), and in that the further cutting teeth (12), following on from the leading cutting tooth (12*a*), of the cutting tooth group (11) have constantly diminishing flattenings (13) following an equal course.

2. The resealable pouring spout as claimed in claim 1, characterized in that the leading cutting tooth (12*a*) in the cutting direction has frontally in the cutting direction (S) an inclined chamfer (14) on the flattening (13*a*), which chamfer avoids premature penetration of the flexible film.

3. The resealable pouring spout as claimed in claim 2, characterized in that the chamfer (14) opens out in an extensively tapered manner into a cutting edge (15) running substantially parallel to a rotational axis of the cutting device (1).

4. The resealable pouring spout as claimed in claim 3, characterized in that the cutting device (1) has a partially cylindrical body (10), and the cutting edge (15) lies in an outer face of the partially cylindrical body (10).

5. The resealable pouring spout as claimed in claim 3, characterized in that the cutting system (4) of the cutting device (1) has in a sector of the cutting circle circumference an outflow recess.

6. The resealable pouring spout as claimed in claim 5, characterized in that the cutting system (4) has a plurality of cutting tooth groups (11), and the cutting tooth groups are arranged distributed over at least three-quarters of the cutting circle circumference in order to approximately balance axially acting forces in a penetration operation.

7. The resealable pouring spout as claimed in claim 1, characterized in that the cutting system (4) of the cutting device (1) has in a sector of the cutting circle circumference an outflow recess.

8. The resealable pouring spout as claimed in claim 1, characterized in that the cutting system (4) has a plurality of cutting tooth groups (11), and the cutting tooth groups are arranged distributed over at least three-quarters of the cutting circle circumference in order to approximately balance axially acting forces in a penetration operation.

* * * * *